United States Patent [19]

Naka

[11] 4,321,293

[45] Mar. 23, 1982

[54] STAIR MAT

[76] Inventor: Hiromitsu Naka, c/o Tokyo Kenkyusho of Kabushiki Kaisha Naka Gijutsu Kenkyusho, 39, Oaza Shinmachi, Yashio-shi, Saitama-ken, Japan

[21] Appl. No.: 94,303

[22] Filed: Nov. 13, 1979

[30] Foreign Application Priority Data

| | | | |
|---|---|---|---|
| Nov. 13, 1978 | [JP] | Japan | 53/155063 |
| Feb. 21, 1979 | [JP] | Japan | 54/20283 |
| Feb. 23, 1979 | [JP] | Japan | 54/21763 |

[51] Int. Cl.[3] ..... B32B 3/30; E04F 11/16

[52] U.S. Cl. ..... 428/60; 428/62; 428/99; 428/167; 428/188; 52/179; 52/188; 428/57

[58] Field of Search ..... 428/45, 68, 99, 101, 428/121, 192, 223, 40, 41, 57, 58, 61, 44, 62, 56, 47, 60, 167, 188; 52/179, 191, 188, 822, 827

[56] References Cited

U.S. PATENT DOCUMENTS

| | | | |
|---|---|---|---|
| 1,789,875 | 1/1931 | Loudenslager | 52/179 |
| 2,205,044 | 6/1940 | Moore | 52/179 |
| 2,288,470 | 6/1942 | Lorraine | 52/179 |
| 2,847,732 | 8/1958 | Hyman | 52/179 |
| 4,151,320 | 4/1979 | Naka | 428/163 |

*Primary Examiner*—George F. Lesmes
*Assistant Examiner*—Alexander S. Thomas
*Attorney, Agent, or Firm*—Wenderoth, Lind & Ponack

[57] ABSTRACT

A stair mat is installed on the stairs by adapting an edge cushion cover and a tread mat on the tread of the stairs adjacent to each other; a rigid or semi-rigid fixing tongue is projected from the front edge of the tread mat, and the edge cushion cover is detachably set on the fixing tongue so as to cover the forward edge of the stairs.

4 Claims, 13 Drawing Figures

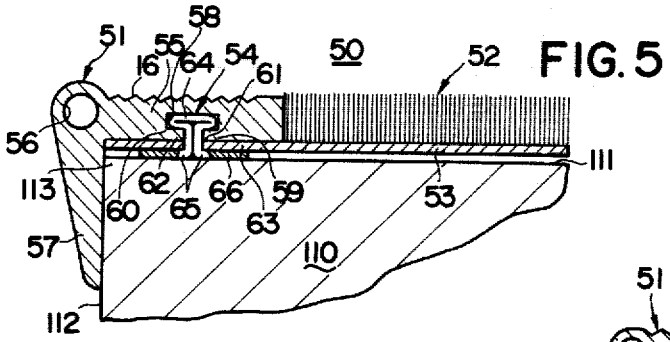
FIG. 5
FIG. 6
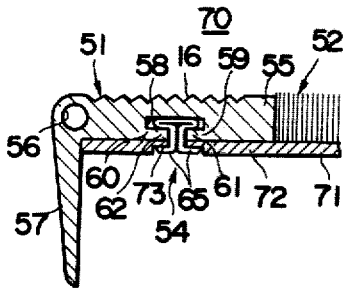
FIG. 7
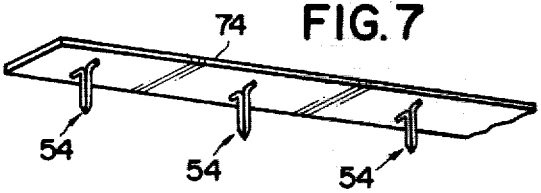
FIG. 8
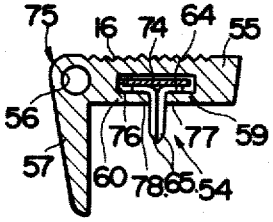
FIG. 9
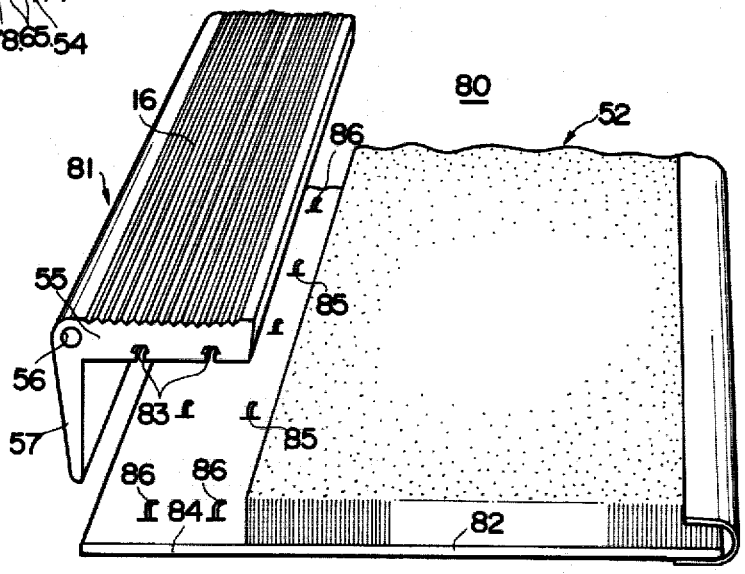

STAIR MAT

BACKGROUND OF THE INVENTION

This invention relates to a stair mat adapted to be installed on stairs, especially stairs located on to the inside of a building.

In general, stair nosings are installed on the edge of steps for the purpose of preventing one from missing his or her footing on the stairs and of avoiding the danger attended with stumbling. On the other hand, carpeting is applied to the stairs for decorative and sound absorption purposes, for imparting a buffer action, and for imparting thermal insulation and flexibility properties to the stairs; such carpeting usually being fixed by stair rods.

When only stair nosings, are installed the sound absorption, thermal insulation and the flexibility properties are lacking on the steps the buffer action is insufficient, and when only carpets are used, the carpets are worn away at the edge of the steps. Accordingly, the carpets must be changed frequently when worn or dirty, which is expensive. There is a tendency to install the stair nosing and the narrow carpet in one united body, or to install the stair nosing and the narrow carpet separately on the steps. However, the former is expensive because when either the stair nosing or the carpet is worn away or damaged, the whole unit must be removed, which is both difficult and expensive. On the other hand, when the units are installed separately, the installation is difficult and it brings into existence undesirable dispersion, for it is installed in such a manner that the stair nosing and the carpet are placed side by side or one above the other by driving in a nail or by screws.

SUMMARY OF THE INVENTION

Therefore, one object of the present invention is to provide a stair mat which can prevent a person from missing one's footing on the stairs and the injuries involved with stumbling. This is achieved by covering the edge of the stair with a nonskid, cushioned, stair mat having sound absorption, and thermal insulation properties, as well as flexibility and ornamental effects.

Another object of the present invention is to provide a stair mat which can be easily installed on each of the steps, being clear of undesirable dispersion and can be easily changed according to the extent in which it is worn out or damaged.

BRIEF DESCRIPTION OF THE DRAWINGS

The above and other objects and attendant advantages of the present invention will be more readily apparent to those skilled in the art from the following description when read in connection with the accompanying drawings, in which:

FIG. 5 is a fragmentary cross-sectional view of the stair mat installed on the stairs of a building as shown in FIG. 4;

FIG. 6 is a fragmentary cross-sectional view of a further modified embodiment of the stair mat of the present invention;

FIG. 7 is a perspective view of a modification of a hook-shaped pin adapted to the stair mat of the present invention;

FIG. 8 is a cross-sectional view of a modification of the edge cushion cover used for the stair mat of the present invention so as to be adapted to the hook-shaped pin;

FIG. 9 is a fragmentary deal perspective view of a modified embodiment of the stair mat of the present invention;

DETAILED DESCRIPTION OF THE INVENTION

Figure 1:
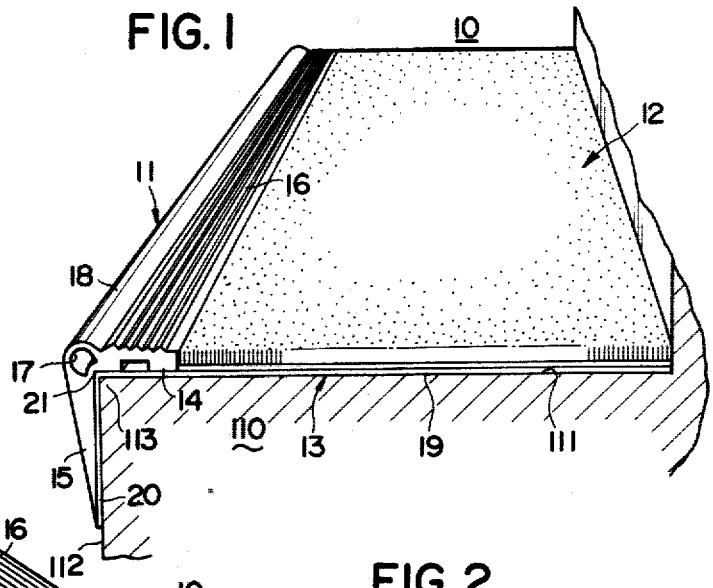
FIG. 1 is a perspective view of a preferred embodiment of a stair mat installed on the stairs of a building.
Figure 2:
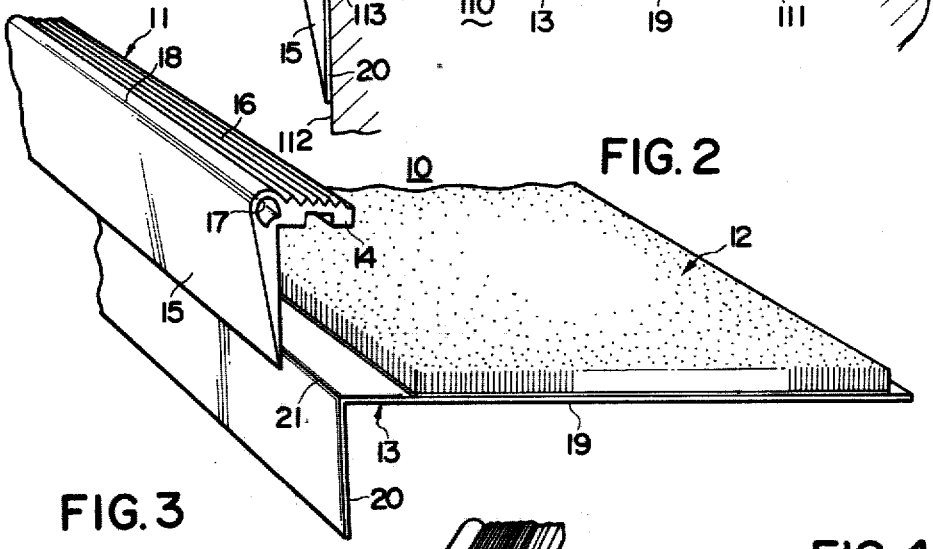
FIG. 2 is a fragmentary deal perspective view of the embodiment as shown in FIG. 1.

The present invention will be now described in reference to the accompanying drawings and more particularly, to FIGS. 1 and 2 in which the first embodiment of the stair mat constructed in accordance with the present invention is shown. The stair mat is generally shown with reference numeral 10 and installed on the stairs 110 of a building. The stair mat 10 includes an edge cushion cover 11, a tread mat 12 and a fixing tongue 13 being projected from the under surface of the front edge of the tread mat 12 fixing the edge cushion cover 11 and the tread mat 12 on a tread of a step.

The edge cushion cover 11, which may be produced from flexible synthetic resin of polyvinyl chloride resin, urethane or the like, has an L-shaped cross-section; and a main body 14 of a horizontal strip having a required width is provided downwards with a skirt 15 at the end. The main body 14 has a non-skid top surface portion 16 on the upper surface, such as serrations and has a cavity 17 at the inside, giving it an elasticity similar to that of the tread mat 12. A hollow distended portion 18 is formed at the border of the main body 14 and the skirt 15, and the distended portion 18 has non-skid effects and elasticity. A double-faced adhesive tape is attached on the under surfaces of the main body 14 and the skirt 15 of the edge cushion cover 11 and, the edge cushion cover 11 is adhered on the fixing tongue 13 of the tread mat 12, thus covering the edge of the step.

The edge cushion cover 11 is therefore removably adhered on the fixing tongue 13 of the tread mat 12 by the adhesive tape.

The tread mat 12 is a common carpet, a felt or the like, having a square-shape, which is provided with a base sheet member 19 on the under surface having a fixing tongue 13 at the front edge.

The edge cushion cover 11 is integrally adhered onto the fixing tongue 13, projected from the front edge of the tread mat, the edge cushion cover 11 is integrally adhered, which fixing tongue is adjacent to the tread mat 12.

The tread mat 12 may have various shapes, being semi-cylindrical or half elliptical, as occasion demands.

The fixing tongue 13 and the base sheet member 19 are used to connect the edge cushion cover 11 and the tread mat 12 and hold them into firm position. The base sheet is a rather heavy weight material, being produced from a rather unbendable semi-rigid synthetic resin, a latex, rubber, or the like, and which is formed into an L-shaped cross section. This is comprised of a horizontal base sheet member 19 of a thin plate adapted to cover the entire the surface of the tread 111 of the step 110, and an anchoring sheet 20 bent at a right angle to the base sheet member 19 so as to be adapted to the vertical surface of the step.

In the installation of the stair mat 10 of the present invention, a double-faced adhesive tape is attached to several parts of the under surfaces of the base sheet member 19 of the tread mat and the anchoring sheet 20, and the base sheet member 19 is set on the tread 111 of the step 110 and also the anchoring sheet 20 is set on the riser 112 of the step 110, respectively. The base sheet member 19 and the anchoring sheet 20 are pressed on the tread 111 and the riser 112. The fixing tongue 13 is adhered on the step 110.

Also a double-faced adhesive tape is attached to the under surface of the main body 14 and the edge portion 15 of the edge cushion cover 11. The edge cushion cover 11 is set on the fixing tongue 13, covering the edge 21 of the base sheet member 19 and the anchoring sheet 20 of the fixing tongue 13. Then the edge cushion cover 11 is pressed so as to be adhered on the fixing tongue 13.

The stair mat 10 of the present invention, has a non-skid effect at the edge cushion cover 11 and the tread mat 12, and has sound absorption, cushioning, and thermal insulation effects and so on. The edge cushion cover 11 can be easily changed for a new one, by tearing it off of the fixing tongue 13.

Figure 3:
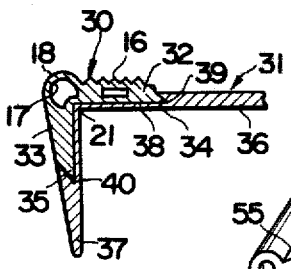
FIG. 3 is a cross-sectional view of a modification of the edge cushion cover of flexible synthetic resin and the connecting base sheet member, adapted to the stair mat of the present invention.

FIG. 3 shows a modification of the edge cushion cover 30 of a flexible synthetic resin and the fixing tongue 31, adapted to the stair mat of the present invention.

The edge cushion cover 30 is integrally provided with a V-shaped cross-section thrusting edge 34, 35 extended along the forward edge of the step at the main body 32 and the skirt 33, and the fixing tongue 31 of the base sheet member 36 is integrally provided with an anchoring sheet 37 at the front edge which becomes thin at the transition point between the base sheet member 36 and the anchoring sheet 37, and is provided with V-shaped cross-section groove 39, 40 at a thinned dent portion 38 between the base sheet member 36 and the anchoring sheet 37, so as to insert the thrusting edge 34, 35 into the groove 39, 40 when the edge cushion cover 30 is adhered to the thin portion of the fixing tongue 31.

The structural elements of the edge cushion cover 30, corresponding to one of the edge cushion cover 11 as, above-mentioned are designated by the same numerals and a description of these corresponding parts is omitted.

Owing to the stair mat 10 of the present invention, it is easy to handle and install, and the edge cushion cover 30 and the tread mat is not peeled off the step 110, since the edge cushion cover 30 is adhered on the fixing tongue 31 of the base sheet member 36 so as to set in the thin portion, and the tread mat is adhered on the fixing tongue 31, and further, the fixing tongue 31 is fixed on the step 110. The edge cushion cover 30 can be immediately changed for another one, if damaged, since the edge cushion cover 30 is removably installed on the fixing tongue 31. This is economical, since the tread mat is used continuously.

Figure 4:
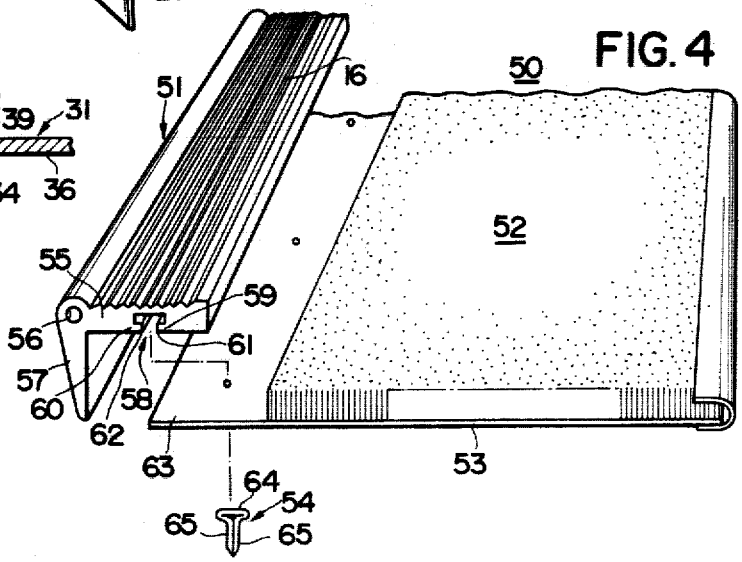
FIG. 4 is a fragmentary deal perspective view of a modified embodiment of the stair mat of the present invention.

FIGS. 4 and 5 show a modified embodiment of the stair mat of the present invention, which is adapted to the stairs of a building.

The stair mat is comprised of the edge cushion cover 51, the tread mat 52 and the fixing tongue 53 adhered on the under surface of the tread mat 52, and the edge cushion cover 51 is removably set on the fixing tongue 53, projecting from the front edge of the tread mat 52, keeping the edge cushion cover 51 adjacent to the tread mat 52, by the use of a plurality of hook-shaped pins 54.

The edge cushion cover 51 is produced of flexible or rigid synthetic resin, rubber or the like, a hollow cushioning portion 56 is formed at the forward edge of the main body 55 of a strip having a predetermined width, and a skirt 57 is integrally extended downwardly from the under surface of the forward edge of the main body 55.

Furthermore, the edge cushion cover 51 is provided with a groove 58 extended in a longitudinal direction at the under surface of the main body 55.

The groove 58 is integrally provided with flange 61, 62 at the opposite sides 59, 60 of an opening, so as to be able to slidably insert the head 64 of the hook-shaped pin 54 into it.

The edge cushion cover 51 has a non-skid top surface portion 16 on the upper surface of the main body 55, such as serrations, thereby improving a non-skid effect.

The tread mat is a common carpet, a felt or the like, which is square-shaped, so as to cover substantially the tread 111 of the step 110, and which is provided on the upper surface with a base sheet member 53 having a fixing tongue 63 at the front edge.

The base sheet member 53 is a thin sheet being formed of a fabric, latex, rubber or the like, and which is provided with a fixing tongue 63 along the forward edge 113 of the step 110, projecting from the front edge of the tread mat 52. Needless to say, the fixing tongue 63 has enough width to set the main body 55 of the edge cushion cover 51 on the upper surface.

The hook-shaped pin 54 connecting the edge cushion cover 51 to the fixing tongue 63 is T-shaped, comprising the head 64 and a pair of bendable legs 65.

In order to set the edge cushion cover 51 on the fixing tongue 63, the head 64 of the hook-shaped pin 54 is slidably put into the groove 58 of the edge cushion cover 51, as shown in FIG. 5, and a pair of bendable legs 65 of the hook-shaped pin 54 is thrusted into the fixing tongue 63, and then is bent on both sides at the under surface of the fixing tongue 63 as shown in FIG. 5. As abovementioned, the main body 55 of the edge cushion cover 51 is overlapped on the fixing tongue 63, being adjacent to the tread mat 52, and which is fixed on the fixing tongue 63 by a plurality of hook-shaped pins 54. These hook-shaped pins 54 may be set on the fixing tongue 63 in advance, the edge cushion cover 51 can be fixed on the fixing tongue 63, by slidably placing the head 64 of the hook-shaped pin 54 into the groove 58 of the edge cushion cover 51 so as to overlapped each other.

In the installation of the stair mat 50, the tread mat 52 is adhered on the upper surface of the fixing tongue 63, and the edge cushion cover 51 is fixed on the fixing tongue 63 by a plurality of hook-shaped pins 54. By attaching an adhesive tape on the under surface of the fixing tongue 63 and the base sheet member 53, the stair mat 50 is then installed on the step 110. Therefore, the stair mat 50 attached the adhesive tape, is fixed on the tread 111 of the step 110 by pressing, so as to set the edge cushion cover 51 with the fixing tongue 63 and the tread mat 52 on the tread 111 of the step 110, putting the skirt 57 of the edge cushion cover 51 on the riser 112 of the step 110.

FIG. 6 shows partially a further modified embodiment of the stair mat 70 of the present invention.

The stair mat 70 is comprised of an edge cushion cover 51, a tread mat 52 and a fixing tongue 72 being formed at the base sheet member 71 of the tread mat 52. By the use of a plurality of hook-shaped pins 54, the edge cushion cover 51 is fixed on the fixing tongue 72, it especially being intended that the bended legs 65 of the hook-shaped pin 54 may be embedded in the thickness of the fixing tongue 72.

The fixing tongue 72 is provided with a cavity or a groove 73 at the under surface. The fixing tongue 72 and the base sheet member 71 are also formed of a fabric, latex or the like, as is the above-mentioned fixing tongue 72 and the base sheet member 71 of the stair mat 70.

The hook-shaped pin 54 is used on the under surface of the connecting strip plate 74, at specified intervals of a particular distance as shown in FIG. 7. In this case, the hook-shaped pin 54 can be easily placed into the groove of the edge cushion cover.

FIG. 8 shows a modification of the edge cushion cover 75 so as to be adapted to the hook-shaped pin 54 as shown in FIG. 7.

The width of the groove 76 and the distance between the flanges 77, 78 of the edge cushion cover 75 are formed larger than that of the edge cushion cover 51, so as to be able to put the connecting strip plate 74 into it. The corresponding parts of the edge cushion cover 75 to the edge cushion cover 51 are designated by the same numerals.

Figure 10:
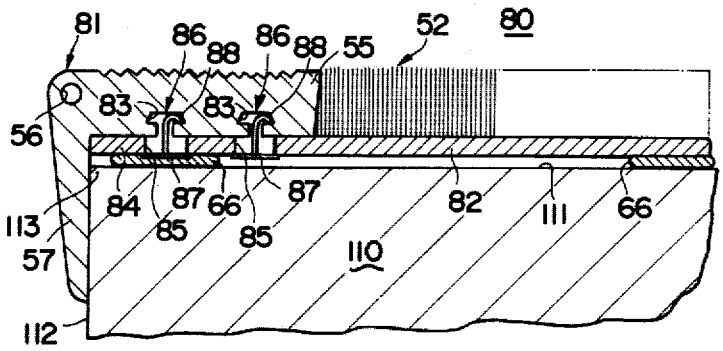
FIG. 10 is a fragmentary cross-sectional view of the stair mat installed on the stairs of a building as shown in FIG. 9.

FIGS. 9 and 10 show a modified embodiment 80 of the stair mat of the present invention, which is adapted to the stairs 110 of the building.

The stair mat 80 is comprised of an edge cushion cover 81, a tread mat 52 and a fixing tongue 84 being formed at the base sheet member 82, by using the hook-shaped pin 86.

The edge cushion cover 81 is provided with two grooves 83 with flanges at the under surface of the main body 55.

The fixing tongue 84 is formed at the base sheet member 82 of the tread mat 52, and is provided with a plurality of fixing holes 85 for the hook-shaped pin 86.

The fixing holes 85 are formed in a spaced longitudinal direction of the grooves 83 with flanges, on the fixing tongue 84, at the corresponding position to the groove 83 with a flange of the edge cushion cover 81.

The hook-shaped pin 86 is comprised of a round shaped head 87 and a U-shaped hook member 88 extended integrally from the head 87, which is set in each fixing hole 85 as shown in FIG. 10, and which is fixed on the fixing tongue 84, by adhering the head 87 on the under surface of the fixing tongue 84.

The manner of installing of the stair mat 80 is similar to that of the stair mat 50, as above-mentioned.

The stair mat 50, 80 in which the edge cushion cover 51, 81 is fixed on the fixing tongue 63, 84 of the base sheet member 53, 82 by the hook-shaped pin 54, 86, provides an easy installation and makes it possible to firmly install the stair mat. Further, the stair mat is of excellent workmanship, since the hook-shaped pin 54, 86 is not exposed on the upper surface of the edge cushion cover 51, 81. The various combinations of the edge cushion cover 51, 81 and the tread mat 52 can be possible without restriction of the quality and the thickness of the edge cushion cover 51, 81 and the tread mat 52. Further, if the edge cushion cover 51, 81 is formed of a flexible material, the groove 58, 83, with flanges, heightens the cushioning effect of the edge cushion cover 51, 81, and gives a softer feeling to the step.

Figure 11:
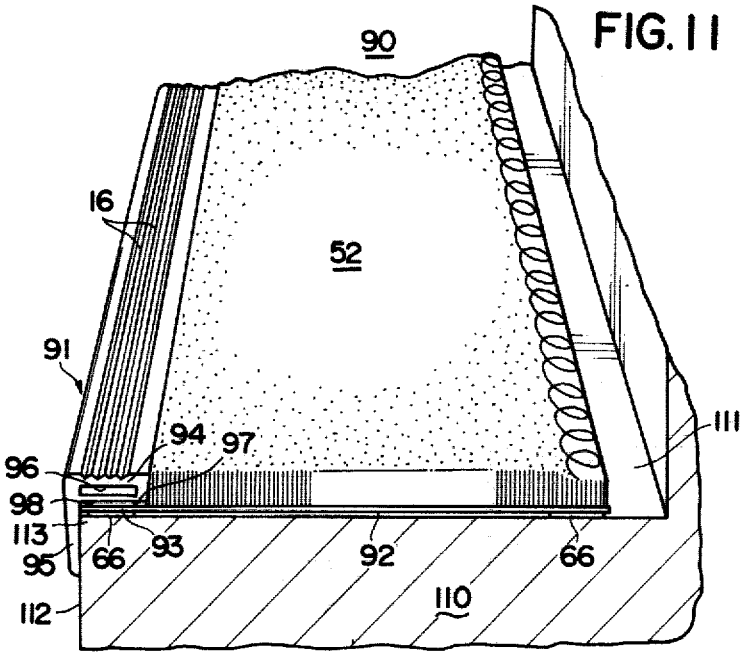
FIG. 11 is a fragmentary perspective view of a modified embodiment of the stair mat of the present invention, which is installed on the stairs of a building.
Figure 12:
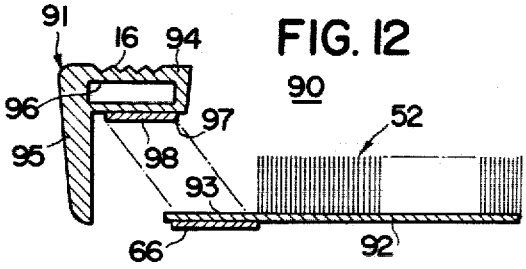
FIG. 12 is a fragmentary deal cross-sectional view of the stair mat as shown in FIG. 11.

FIGS. 11 and 12 show a modified embodiment 90 of the stair mat of the present invention, which is adapted to the stairs 110 of the building.

The stair mat 90 is comprised of an edge cushion cover 91, a tread mat 52 and a fixing tongue 93, being formed at the base sheet member 92 on the tread mat 52. The edge cushion cover 91 is removably adhered on the fixing tongue 93 by the use of the adhesive tape.

The edge cushion cover 91 is formed of an L-shaped cross-section and made of a flexible synthetic resin, provided with a hollow portion 96 at the main body 94, thereby heightening the cushioning effect. The edge cushion cover 91 is integrally provided with a skirt 95 extended downwardly from the front edge of the main body 94 and is provided with a non-skid top surface portion 16 on the upper surface of the main body 94, such as serrations.

The adhesive layer 97 of the adhesive tape 98 is attached to the under surface of the main body 94 of the edge cushion cover 91, so as to be able to fix on the fixing tongue 93.

The tread mat 52 is a common carpet, a deep-pile carpet, a foot-cloth or the like, keeping its fringe at the rear and the opposite side edges in curl by the same kind of pile as the tread mat 52, or being sewn of a plastic sheet or a cloth on the rear and the opposite side edges, so as not to be frayed or pulled out.

The manner of installation of the stair mat 90 is similar to that of the stair mat 10, 50, 70, 80 as above-mentioned.

Figure 13:
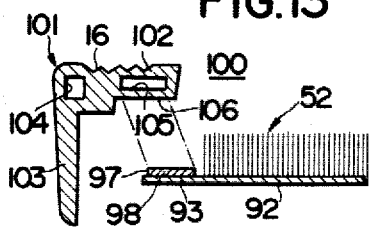
FIG. 13 is a fragmentary deal cross-sectional view of a further modified embodiment of the stair mat of the present invention.

FIG. 13 shows a further modified embodiment 100 of the stair mat of the present invention, which is adapted to the stairs 110 of the building.

The stair mat 100 is changed to the shape of the edge cushion cover 91 in the stair mat 90 as shown in FIGS. 11 and 12, and the adhesive sheet 98 is set on the fixing tongue 93.

The edge cushion cover 101 is provided with hollow portions 104, 105 at the front and rear portion of the main body 102, integrally provided with a skirt 103, and is provided with a notched cavity 106 at the under surface of the main body 102, embedding the thickness of the fixing tongue 93 of the base sheet member 92 and the adhesive layer 97 into the main body 102 of the edge cushion cover 101, so as to prevent an increase of the thickness of the main body 102.

The manner of installing of the stair mat 100 is similar to that of the stair mat 100 as above-mentioned, however, when the edge cushion cover 101 is fixed on the fixing tongue 93 of the base sheet member 92, the thickness of the main body 102 of the edge cushion cover 101 is not increased in comparison with the stair mat 90 as above-mentioned.

While several preferred embodiments of the invention have been shown and described in detail, it will be understood that the same are for illustration pruposes only and not to be taken as a definition of the invention, reference being had for this purpose to the appended claims.

What is claimed is:

1. A stair mat comprising:

an edge cushioning cover adapted to cover the front edge of a step, including a main body having a longitudinal hollow portion in the inside thereof and a non-skid top surface portion on the upper surface thereof, and a shirt extended downwardly from the front edge of the main body;

a tread mat adapted to be secured onto the tread of the step;

a fixing tongue formed integrally at the front edge of the tread mat; and a detachable adhesive sheet securing means detachably securing the edge cushioning cover onto the upper surface of the fixing tongue.

2. A stair mat as claimed in claim 1, in which the edge cushioning cover is provided with a notched cavity at the under surface of the main body, wherein the thickness of the fixing tongue is embedded in the notched cavity of the main body.

3. A stair mat as in claims 1 or 2 in which the non-skid surface has serrations thereon.

4. A stair mat according to claims 1 or 2 in which the tread mat is a carpet.

* * * * *